US005292976A

United States Patent [19]

Dessau et al.

[11] Patent Number: 5,292,976

[45] Date of Patent: Mar. 8, 1994

[54] PROCESS FOR THE SELECTIVE CONVERSION OF NAPHTHA TO AROMATICS AND OLEFINS

[75] Inventors: Ralph M. Dessau, Edison; Mohsen N. Harandi, Lawrenceville, both of N.J.

[73] Assignee: Mobil Oil Corporation, Fairfax, Va.

[21] Appl. No.: 52,964

[22] Filed: Apr. 27, 1993

[51] Int. Cl.[5] ..... C07C 4/00; C07C 4/06; C10G 63/04

[52] U.S. Cl. ..... 585/322; 585/324; 585/651; 585/653; 208/62; 208/100

[58] Field of Search ..... 585/322, 324, 653, 651; 208/62, 100

[56] References Cited

U.S. PATENT DOCUMENTS

| | | | |
|---|---|---|---|
| 3,192,150 | 6/1965 | Taylor et al. | 208/62 |
| 3,714,023 | 1/1973 | Stine | 208/62 |
| 4,035,285 | 7/1977 | Owen | 208/120 |
| 4,179,474 | 12/1979 | Beuther et al. | 208/57 |
| 4,594,144 | 6/1986 | James et al. | 208/62 |
| 4,867,864 | 9/1989 | Dessau | 208/138 |
| 4,935,566 | 6/1990 | Dessau et al. | 208/65 |
| 4,969,987 | 11/1990 | Le et al. | 208/67 |
| 5,013,423 | 5/1991 | Chen et al. | 208/64 |
| 5,037,531 | 8/1991 | Budens et al. | 208/120 |

*Primary Examiner*—Anthony McFarlane
*Attorney, Agent, or Firm*—Alexander J. McKillop; Malcolm D. Keen; Gene L. Wise

[57] ABSTRACT

A staged process has been discovered for the selective conversion of paraffins in naphtha to aromatics and conversion of naphthenes in naphtha to olefins. In a first stage, n-paraffins in naphtha are converted to aromatics over modified non acidic zeolite catalyst particles with a low conversion of naphthenes in the feedstream. The effluent from the first stage is cascaded to a second stage reactor containing acidic zeolite catalyst wherein naphthenes are converted to light olefins. Advantageously, the process of the invention results in a reduction in the production of light $C_1$–$C_4$ paraffins compared to the prior art. The preferred catalyst for the first stage is a platinum modified zeolite containing tin.

21 Claims, 1 Drawing Sheet

PROCESS FOR THE SELECTIVE CONVERSION OF NAPHTHA TO AROMATICS AND OLEFINS

This invention relates to a staged process for the conversion of $C_6+$ naphtha to aromatics and light olefins with a minimum production of $C_3-$ paraffins. The process is carried out in two stages comprising a first paraffins aromatization/dehydrocyclization catalytic reaction zone followed by a naphthenes catalytic cracking zone.

BACKGROUND OF THE INVENTION

Catalytic reforming is a process in which hydrocarbon molecules are rearranged, or reformed in the presence of catalyst. The molecular rearrangement results in an increase in the octane rating of the feedstock. Thus, during reforming low octane hydrocarbons in the gasoline boiling range are converted into high octane components by dehydrogenation of naphthenes and isomerization, dehydrocyclization and hydrocracking of paraffins.

Naphtha reforming may also be used for the production of benzene, toluene, ethylbenzene and xylene aromatics. Generally, the molecular rearrangement of molecular components of a feed, which occurs during reforming, results in only slight changes in the boiling point of the reformate (the product of reforming).

Reformate comprises a large percentage of finished pool gasoline, up to 80% in topping-reforming refineries. With the advent of non-lead gasolines, more straight run stocks usually blended into gasoline are now reformed. Commercial reformers use a platinum containing catalyst with a hydrogen recycle stream. The typical processes can be classified initially according to the approach to catalyst regeneration, i.e., semi-regenerative, cyclic or continuous with cyclic and continuous units operated at low pressure (<300 psig).

In the late 1960's platinum-rhenium bimetallic catalysts were introduced with a high selectivity for cracking. Recently, platinum and non-acidic zeolite containing catalyst compositions have been introduced in reforming. Zeolites include naturally occurring and synthetic zeolites. It has been reported that such non-acidic catalysts demonstrate superior selectivities in reforming.

More recent governmental regulations prescribing the production of cleaner fuels particularly containing less benzene, aromatics and more oxygenated compounds have technically challenged the petroleum refining industry to meet those regulations while minimizing economic upset to refinery operations and unit processes. Naphtha catalytic reforming which plays a major role in the refinery in upgrading low octane value hydrocarbons is a focal point for process improvement. Higher linear and low branched paraffin conversion to aromatics, particularly $C_7+$ aromatics, and higher overall selectivity to high octane value compounds is sought for. It is also desirable to achieve these objectives while reducing or at least not increasing the make of low value light $C_1$–$C_4$ paraffins which are typically a by-product of naphtha cracking/reforming.

The instant invention provides a major accomplishment in paraffins upgrading by dehydrocyclization-/aromatization combined with cracking operations. The following patents while related to the instant invention do not teach or suggest that invention and are incorporated herein by reference in their entirety.

U.S. Pat. No. 4,867,864 to Dessau (Sep. 19, 1989) discloses a catalytic process for the conversion of a paraffin feed to effluents with increased aromaticity wherein the catalyst comprises low acid value zeolite Beta in combination with a strong dehydrogenation/hydrogenation metal.

U.S. Pat. No. 4,935,566 to Dessau, et al (Jun. 19, 1990) discloses a dehydrocyclization and reforming process for paraffins employing preferably a non acidic platinum-tin containing crystalline micro porous material.

U.S. Pat. Nos. 4,969,987 and 5,100,533 to Le et al, incorporated herein by reference, disclose a process for upgrading paraffinic naphtha by cracking over medium pore zeolite catalyst to produce at least 10 wt % isoalkene. The preferred feedstock is straight run naphtha containing $C_7+$ alkanes, at least 15 wt % $C_7+$ naphthenes and less than 20% aromatics.

U.S. Pat. No. 5,013,423, to Chen, et al (May 12, 1991) teaches a process for the manufacture of aromatics from normal hexane and normal heptane using a non-acidic indium catalyst containing platinum.

U.S. Pat. No. 4,035,285 to Owen (Jul. 12, 1977) discloses a process for the catalytic cracking of high boiling hydrocarbons in the presence of crystalline zeolite conversion catalyst and hydrogen.

U.S. Pat. No. 5,037,531 to Budens, et al (Aug. 6, 1991) discloses a catalytic cracking process using Y zeolite.

It is an object of the present invention to provide a process for the conversion of naphtha to high octane value hydrocarbons with a high selective conversion of acyclic paraffins, particularly low octane linear paraffins, to aromatics.

It is another object of the present invention to provide a process for the conversion of naphtha wherein a significant portion of naphthenes in the naphtha feedstream are concomitantly converted to light olefins.

Another object of the invention is to produce petrochemical feed stocks including light aromatics and light olefins from naphtha.

Yet a further object of the present invention is to provide a process for naphtha upgrading to aromatics and olefins with a reduced production of light $C_1$–$C_3$ paraffins.

An additional object of the invention is to provide a process which upgrades naphtha to aromatics and branched paraffins rich gasoline and ethene, propene and butene rich light gas.

SUMMARY OF THE INVENTION

A staged process has been discovered for the selective conversion of paraffins in naphtha to aromatics and conversion of naphthenes in naphtha to olefins. In a first stage, a major portion of n-paraffins in naphtha is converted to aromatics over modified non acidic zeolite catalyst particles containing a group VIII metal of the Periodic Chart Of the Elements (as exhibited in Merck Index, 11th Edition, 1989, front cover back) and optionally modified by tin (Sn), Indium (In) or Thallium (Tl). with a low conversion of naphthenes in the feedstream. The effluent from the first stage is cascaded to a second stage reactor containing cracking catalyst wherein naphthenes are converted to light olefins. Advantageously, the process of the invention results in a reduction in the production of light $C_1$–$C_3$paraffins compared to the prior art. The preferred catalyst for the first stage is a platinum modified zeolite containing tin.

More particularly, a staged process for the selective conversion of $C_6+$ naphtha hydrocarbon feedstream containing n-paraffins and naphthenes to $C_6+$ aromatics and light olefins with a reduced production of $C_3-$ paraffins has been discovered. The process comprises contacting the feedstream in a first aromatization reaction zone with nonacidic, preferably medium pore shape selective, zeolite catalyst particles containing metal from Group VIII optionally modified by Group IVB of the Periodic Chart of the Elements under aromatization reaction conditions whereby a high selective conversion of said n-paraffins to said aromatics is achieved and the first reaction zone effluent is rich in unconverted naphthenes. The effluent is passed without separation to a cracking zone in contact with an acidic catalyst, preferably medium pore shape selective zeolite catalyst particles, under cracking conditions whereby conversion of unconverted naphthenes and paraffins to light olefins is achieve while $C_3-$ paraffins production is reduced. The effluent from said second zone is separated by distillation to recover an overhead stream preferably comprising hydrogen and $C_5-$ olefinic hydrocarbons and a bottom stream comprising $C_6+$ hydrocarbons rich in aromatics.

Optionally, the process includes the further step of separating the first reaction zone effluent by distillation to provide a $C_6+$ hydrocarbon feedstream rich in naphthenes for the second reaction zone. Also, a portion of the distillation bottom stream after cracking can be recycled to the naphtha feedstream and/or the first reaction zone effluent stream.

DETAIL DESCRIPTION OF THE INVENTION

Figure 1:
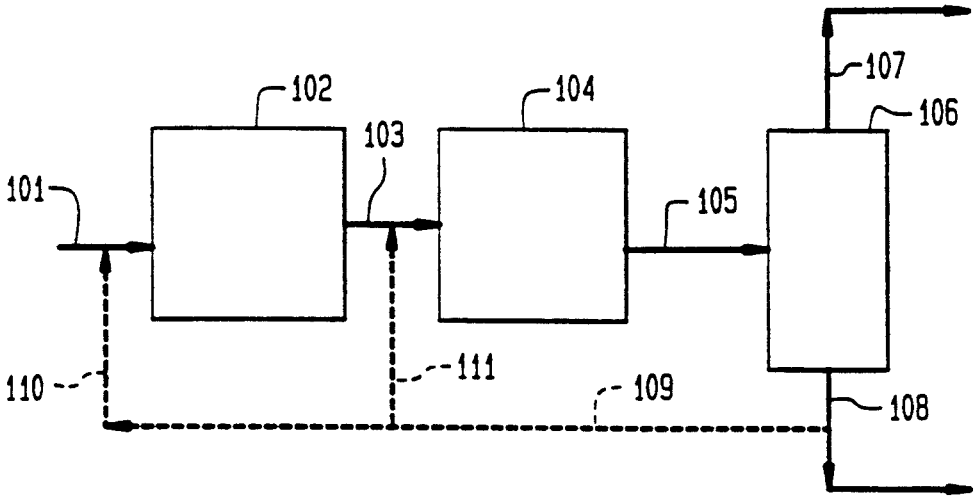
FIG. 1 is a schematic drawing of one embodiment of the staged process of the instant invention.

The feedstock charge to the process of the invention can be straight run, thermal, catalytic or hydro-cracker naphthas or any other naphtha containing $C_6$–$C_{12}$ paraffins. Preferably, the naphtha is a paraffin rich naphtha, particularly rich in $C_6$ to $C_{12}$ paraffins. These paraffins comprise both acyclic and cyclic paraffins or naphthenes. Naphthenes, in prior art reforming processes, will in part be cracked, contributing to the production of smaller paraffinic molecules.

Naphthas exhibit boiling point temperature ranges of up to about 430° F. (221° C.). The light naphtha fraction thereof will exhibit a boiling point temperature range of from about 80° F. (27° C.) to about 250° F. (121° C.). Frequently, naphtha feedstock is hydrotreated before reforming to reduce or eliminate sulfur, nitrogen and oxygen derivatives of hydrocarbons present in the feedstock as impurities which can cause more rapid aging of reforming catalyst.

Avoiding the propensity of known conventional catalytic reforming processes to ineffectively consume naphthenes and branched paraffins while producing low value light paraffins below the gasoline boiling range is but one accomplishment of the present invention. In the first reactor branched paraffins and naphthenes conversion occurs but to a significantly lower extent than n-paraffins. In the second stage, conversion of paraffins with two branches is minimized by choosing a shape selective catalyst and appropriate operating conditions in order to preserve high octane paraffins in the gasoline pool. The invention also produces a substantial improvement in the production of high octane value $C_6+$ aromatics.

Two processes are staged or coupled in the present invention to provide the foregoing accomplishments. The first is a modified naphtha reforming process using a non-acidic zeolite catalyst containing preferably platinum and tin. Under process conditions naphtha is converted to aromatics with a selectivity greater than about 80%, based on n-paraffins in the feed. On the other hand, naphthenes in the feedstock are largely unconverted in the first stage of the process. The second process or stage coupled in the present invention comprises acid catalytic cracking. The catalysts used in both stages are preferably shape selective zeolite to minimize conversion of highly branched paraffins. Uniquely, the entire effluent from the first stage is cascaded to the second stage. Here, preferably employing acidic zeolite cracking catalyst, unconverted naphthenes and lightly branched paraffins are converted principally to light olefins, mostly $C_3$–$C_4$ olefins, which are valuable intermediates for etherification, alkylation, etc. Remarkably, the novel process of the invention results in an overall reduction in the production of low value light paraffins, particularly $C_1$–$C_3$ paraffins.

The preferred catalysts used in the first and second stages of the present invention comprise zeolites, i.e., nonacidic zeolites containing Group VIII metal optionally modified with In, Sn or Tl in the first stage and acidic zeolites in the second stage. In the first stage the nonacidic zeolite is preferably medium pore. Recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such Al, Ga, or Fe, within the zeolytic framework. These medium pore zeolites are favored for acid catalysis; however, the advantages of ZSM-5 structures may be utilized by employing highly siliceous materials or crystalline metallosilicate having one or more tetrahedral species having varying degrees of acidity.

In general, the useful catalysts for the second stage embrace two categories of acidic zeolite, namely, the intermediate pore size variety as represented, for example, by ZSM-5, which possess a Constraint Index of greater than about 2 and the large pore variety as represented, for example, by zeolite Y, which possess a Constraint index no greater than about 2. Both varieties of zeolites will possess a framework silica-to-alumina ratio of greater than about 7.

For purposes of this invention, the term "zeolite" is meant to include the class of porotectosilicates, i.e., porous crystalline silicates, which contain silicon and oxygen atoms as the major components. Other components can be present in minor amounts, usually less than 14 mole %, and preferably less than 4 mole %. These components include aluminum, gallium, iron, boron, and the like, with aluminum being preferred. The minor components can be present separately or in mixtures in the catalyst. They can also be present intrinsically in the framework structure of the catalyst. The framework silica-to-alumina mole ratio referred to can be determined by conventional analysis. This ratio is meant to represent, as closely as possible, the mole ratio of silica to alumina in the rigid anionic framework of the zeolite crystal and to exclude any alumina which may be present in a binder material optionally associated with the zeolite or present in cationic or other form within the channels of the zeolite. Although zeolites with a silica-to-alumina mole ratio of as low as about 7 are useful, it is preferred to use zeolites having much higher silica-to-alumina mole rations, i.e., ratios of at least about 20:1 and preferably greater than about 200:1, e.g., 500:1, and even higher. In addition zeolites as otherwise characterized herein but which are substantially free of aluminum, i.e., having silica-to-alumina mole ratios up to and including infinity, are useful and can even be preferable in some cases. The useful class of zeolites, after activation, acquire an intra-crystalline sorption affinity for normal hexane which is greater than that for water, i.e., they exhibit "hydrophobic" properties.

A convenient measure of the extent to which a zeolite provides controlled access to molecules of varying sizes to its internal structure is the aforementioned Constraint Index of the zeolite. A zeolite which provides relatively restricted access to, and egress from, its internal structure is characterized by a relatively high value for the Constrain Index, i.e., above about 2. On the other hand, zeolites which provide relatively free access to the internal zeolitic structure have a relatively low value for the Constraint Index, i.e., about 2 or less. The method by which Constraint Index is determined is described fully in U.S. Pat. No. 4,016,218, to which reference is made for details of the method.

Constraint Index (CI) values for some zeolites which can be used in the process of this invention are:

| Zeolite | Constraint Index (At Test Temperature, °C.) |
|---|---|
| ZSM-4 | 0.5 (316) |
| ZSM-5 | 6-8.3 (371-316) |
| ZSM-11 | 5-8.7 (371-316) |
| ZSM-12 | 2.3 (316) |
| ZSM-20 | 0.5 (371) |
| ZSM-35 | 4.5 (454) |
| ZSM-48 | 3.5 (538) |
| ZSM-50 | 2.1 (427) |
| TMA Offretite | 3.7 (316) |
| TEA Mordenite | 0.4 (316) |
| Clinoptilolite | 3.4 (510) |
| Mordenite | 0.5 (316) |
| REY | 0.4 (316) |
| Amorphous Silica—Alumina | 0.6 (538) |
| Dealuminized Y | 0.5 (510) |
| Zeolite Beta | 0.6-2.0 (316-399) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders Likewise, other variables, such as crystal size of the zeolite, the presence of occluded contaminants, etc., can affect the Constraint Index. Therefore, it will be appreciated that it may be possible to so select test conditions, e.g., temperatures, as to establish more than one value for the Constraint Index of a particular zeolite. This explains the range of Constraint Indices for zeolite Beta.

Useful zeolite catalysts of the intermediate pore size variety, and possessing a Constraint Index of greater than about 2 up to about 12, include such materials as ZSM-5, ZSM-11, ZSM-23, and ZSM-35.

ZSM-5 is more particularly described in U.S. Reissue Pat. No. 28,341 (of original U.S. Pat. No. 3,702,886), the entire contents of which are incorporated herein by reference.

ZSM-11 is more particularly described in U.S. Pat. No. 3,709,979, the entire contents of which are incorporated herein by reference.

ZSM-22 is more particularly described in U.S. Pat. No. 4,046,859, the entire contents of which is incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

MCM-22 is described in U.S. Pat. No. 4,954,325 to M. K. Rubin and P. Chu, issued Sep. 4, 1990. It has a $SiO^{2-}/Al_2O_3$ ratio of 10 to 150, usually 20 to 40, with a high Alpha value, usually above 150.

The large pore zeolites which are useful as catalysts in the process of this invention, i.e., those zeolites having a Constraint Index of no greater than about 2, are well known to the art. Representative of these zeolites are zeolite Beta, zeolite X, zeolite L, zeolite Y, ultrastable zeolite Y (USY), dealuminized Y (Deal Y), rare earth-exchanged zeolite Y (REY), rare earth-exchanged dealuminized Y (RE Deal Y), mordenite, ZSM-3, ZSM-4, ZSM-12, ZSM-20, and ZSM-50 and mixtures of any of the foregoing. Although zeolite Beta has a Constraint Index of about 2 or less, it should be noted that this zeolite does not behave exactly like other large pore zeolites. However, zeolite Beta does satisfy the requirements for a catalyst of the present invention.

Zeolite Beta is described in U.S. Reissue Pat. No. 28,341 (of original U.S. Pat. No. 3,308,069), to which reference is made for details of this catalyst.

Zeolite X is described in U.S. Pat. No. 2,882,244, to which reference is made for the details of this catalyst.

Zeolite L is described in U.S. Pat. No. 3,216,789, to which reference is made for the details of this catalyst.

Zeolite Y is described in U.S. Pat. No. 3,130,007, to which reference is made for details of this catalyst.

The second stage zeolites selected for use herein will generally possess an alpha value of at least about 1, preferably at least 10 and more preferably at least about 100. Nonacidic zeolites are preferred for the first stage. "Alpha value", or "alpha number", is a measure of zeolite acidic functionality and is more fully described together with details of its measurement in U.S. Pat. No. 4,016,218, *J. Catalysis*, 6, pp. 278-287 (1966) and *J. Catalysis*, 61, pp. 390-396 (1980). Zeolites of low acidity (alpha values of less than about 200) can be achieved by a variety of techniques including (a) synthesizing a zeolite with a high silica/alumina ration, (b) steaming, (c) steaming followed by dealuminization and (d) substituting framework aluminum with other species. For example, in the case of steaming, the zeolite(s) can be exposed to steam at elevated temperatures ranging from about 500° F. to about 1200° F. and preferably from about 750° F. to about 1000° F. This treatment can be accomplished in an atmosphere of 100% steam or an atmosphere consisting of steam and a gas which is substantially inert to the zeolite. A similar treatment can be accomplished at lower temperatures employing elevated pressure, e.g., at from about 350° to about 700° F. with from about 10 to about 200 atmospheres. Specific details of several steaming procedures may be gained from the disclosures of U.S. Pat. Nos. 4,325,994; 4,374,296; and 4,418,235, the contents of which are incorporated by reference herein. Aside from, or in addition to any of the foregoing procedures, the surface acidity of the zeolite(s) can be eliminated or reduced by treatment with bulky reagents as described in U.S. Pat. No. 4,520,221, the contents of which are incorporated by reference herein.

The original cations associated with zeolites utilized herein can be replaced by a wide variety of other cations according to techniques well known in the art, e.g., by ionexchange. Typical replacing cations include hydrogen, ammonium, alkyl ammonium and metal cations, and their mixtures. Metal cations can also be introduced into the zeolite. In the case of metal cations, particular preference is given to metals of Groups IB to VIII of the Periodic Table, including, by way of example, iron, nickel, cobalt, copper, zinc, palladium, platinum, tin, calcium, chromium, tungsten, molybdenum, rare earth metals, etc. These metals can also be present in the form of their oxides The first stage naphtha conversion step of the process of the present invention is preferably carried out according to the process more fully described in the aforenoted and referenced U.S. Pat. No. 4,935,566 to Dessau. For that process the zeolite is selected from the group consisting of ZSM-5, ZSM-11, ZSM-12, ZSM-20, ZSM-23, ZSM-48, ZSM-50, MCM-22 and zeolite Beta. The catalyst also includes a hydrogenation/dehydrogenation metal such as platinum. The catalyst also includes tin (Sn) or indium (In).

The first stage conversion step may be carried out in the presence of added hydrogen. When the reforming is undertaken over platinum/tin catalyst the temperature of reforming can range from 800° F. (427° C.) to 1100° F. (593° C.), typically being greater than 900° F. (482° C.), preferably 900° F. to 1050° F. (565° C.); the pressure will be from about 1 atmosphere to 500 psig 3500(kPa), preferably from 30 psig (210 kPa) to 250 psig (1750 kPa); inlet $H_2$/hydrocarbon can be ten or less, even zero, while LHSV (liquid hourly space velocity) can be 0.1 to 20, preferably 0.1 to 10.

The second stage conversion step of the instant invention comprises catalytic cracking. The feedstream to the second stage is preferably the entire effluent of the first stage conversion step which is cascaded to the second stage without separation. However, as circumstances may suggest, the first stage effluent may be separated by distillation or other known methods to remove hydrogen and light hydrocarbons as overhead and pass a bottom stream containing $C_6$+ aromatics and unconverted naphthenes to the catalytic cracking zone wherein naphthenes are converted to light $C_2$–$C_5$ olefins. In either case, the cracking reaction products are separated by distillation to recover high octane value $C_6$+ aromatics and light olefins. In subsequent operations these light olefins consisting of ethene, propene, 1-butene and 1-pentene can be converted to other useful products.

Fluid catalytic cracking is well known and thoroughly described in the prior art as indicated by the U.S. patents referenced herein before. However, for the instant invention cracking particularly relates to naphtha cracking under the conditions as disclosed in the previously referenced U.S. Pat. No. 4,969,987. Naphtha is upgraded by contacting with acid zeolite cracking catalyst at low pressure, up to about 500 kPa, and temperature between 425° C. to 650° C. with space velocities greater than 1/hr WHSV. The catalyst is selected from ZSM-5, ZSM-11, ZSM-12, ZSM-22, ZSM-23, MCM-22 and mixtures thereof.

Referring now to FIG. 1, a schematic flow diagram is depicted illustrating a preferred embodiment of the process of the present invention. A $C_6$+ naphtha feedstream 101, preferably rich in n-paraffins and containing naphthenes, is passed to an aromatization reaction section 102. The reaction section contains preferably ZSM-5 catalyst particles that contain platinum and tin. The particles may preferably be configured as a moving catalyst bed, although fluid catalyst bed or fixed bed reactors can be used in the process. Under low pressure aromatization conditions as previously described, at least 80% of n-paraffins in the naphtha feedstream are converted to $C_6$+ aromatics while a major portion of naphthenes in the feedstream are unconverted. The aromatization zone reaction effluent is cascaded 103 to a second reaction section 104 comprising catalytic cracking, preferably fluid catalytic cracking. In the cracking section, preferably in contact with acidic ZSM-5 under cracking conditions known in the art at least 50 wt. % of the unconverted naphthenes and paraffins in the effluent from the first aromatization reaction zone are partially converted to light olefins. Catalyst deactivation which would typically occur in the second reaction stage is substantially reduced due to the presence of hydrogen produced in the first reaction stage and passed to the second stage. The cracking section effluent is then passed 105 to a product recovery section 106 and separated by distillation. An overhead stream 107 is recovered comprising hydrogen and olefinic $C_5$− hydrocarbons. A bottom stream 108 is recovered comprising aromatic rich $C_6$+ hydrocarbons.

In an optional embodiment of the instant invention, again referring to FIG. 1, a recycle stream 109 may be drawn as a portion of the bottom stream 108 for recycle 110 to the naphtha stream 101 or recycled 111 to the aromatization reaction section effluent 103. Optionally, the recycle stream 109 may be split for recycle to both the aromatization and cracking sections.

Figure 2:
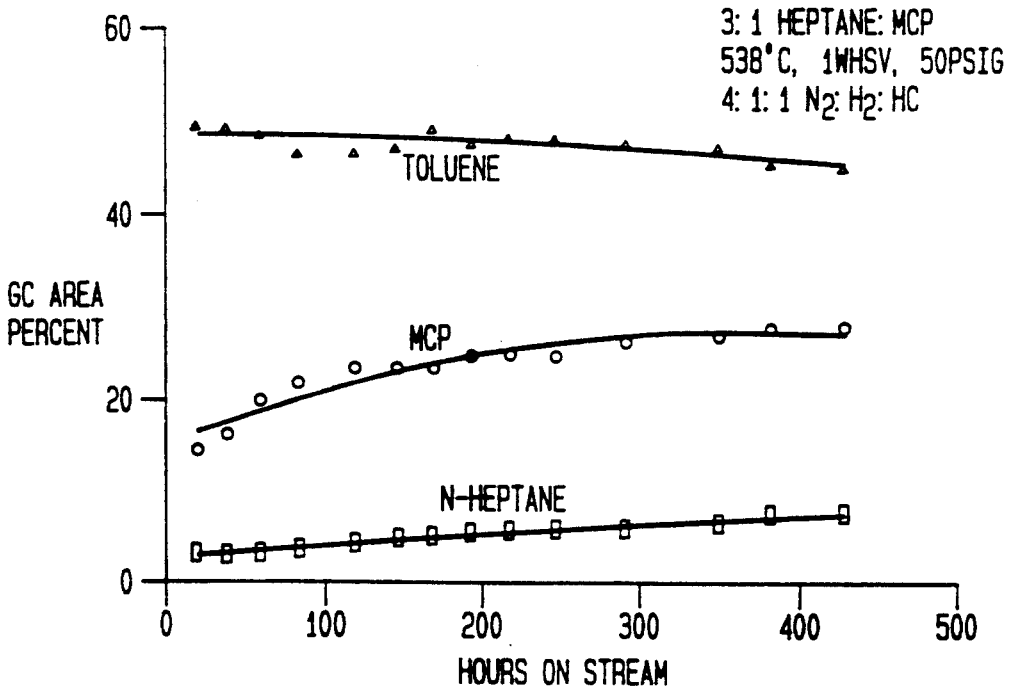
FIG. 2 is a graph depicting feed conversion employing a preferred catalyst of the invention.

Referring to FIG. 2, a graph is presented illustrating the conversion of a model feed for the aromatization section of the instant process employing ZSM-5 catalyst impregnated with platinum and tin.

Table 1 presents a material balance for the process of the instant invention. Table 1 shows that the process of the invention provides high selectivity for the conversion of naphtha to $C_6$ aromatics with only minor conversion of naphthenes in the first stage. As a result, the production of $C_3$-paraffins is low, representing less than 15 wt. % of the final product.

TABLE 1

SELECTIVE NAPHTHA CONVERSION MATERIAL BALANCE

| STREAM | Naphtha Feed Wt % | Stage 1 Prod. Wt % | Stage 2 Prod. Wt % |
|---|---|---|---|
| hydrogen | 0.00 | 4.14 | 4.14 |
| methane | 0.00 | 0.41 | 0.73 |
| ethylene | 0.00 | 0.00 | 1.92 |
| ethane | 0.00 | 0.97 | 1.35 |
| propylene | 0.00 | 0.00 | 2.86 |
| propane | 0.00 | 1.51 | 4.28 |
| i-butane | 0.00 | 0.12 | 0.62 |
| l-butene | 0.00 | 0.00 | 0.67 |
| n-butane | 0.00 | 1.51 | 1.99 |
| i-pentane | 0.00 | 0.20 | 0.24 |
| l-pentene | 0.00 | 0.00 | 0.12 |
| n-pentane | 0.00 | 1.11 | 1.18 |

TABLE 1-continued

SELECTIVE NAPHTHA CONVERSION MATERIAL BALANCE

| STREAM | Naphtha Feed Wt % | Stage 1 Prod. Wt % | Stage 2 Prod. Wt % |
|---|---|---|---|
| cyclopentane | 0.00 | 0.00 | 0.05 |
| i-hexane | 0.00 | 1.71 | 1.04 |
| l-hexane | 0.00 | 0.15 | 0.16 |
| n-hexane | 0.00 | 1.10 | 1.10 |
| MCP | 25.00 | 20.35 | 9.19 |
| cyclohexane | 0.00 | 0.08 | 0.04 |
| benzene | 0.00 | 8.23 | 8.92 |
| i-heptane | 0.00 | 3.60 | 1.44 |
| l-heptane | 0.00 | 0.62 | 0.62 |
| n-heptane | 75.00 | 3.52 | 3.52 |
| dimethylcyclo-pentane | 0.00 | 1.74 | 0.78 |
| methcychexane | 0.00 | 0.17 | 0.22 |
| $C_7$ aromatics | 0.00 | 48.76 | 50.68 |
| $C_8$ aromatics | 0.00 | 0.00 | 1.46 |
| $C_9$ aromatics | 0.00 | 0.00 | 0.36 |
| $C_{10}$ aromatics | 0.00 | 0.00 | 0.09 |
| naphthalenes | 0.00 | 0.00 | 0.19 |
| $C_{11}$ aromatics | 0.00 | 0.00 | 0.02 |
| TOTAL lb/hr | 100.00 | 100.00 | 100.00 |

It has been found that the $C_4$–$C_5$ product fraction of the present invention is particularly amenable to further upgrading to high octane value products by etherification and/or alkylation using etherification or alkylation methods known in the art carried out in contact with acidic catalyst such as solid resin particles or zeolite. After etherification and/or alkylation of $C_4$–$C_5$ product fraction, unconverted $C_4$–$C_5$ hydrocarbons can be recycled to aromatization zone stage 1 for dehydrogenation or passed to cracking zone stage 2 to be upgraded to gasoline and/or olefins.

While the invention has been described by reference to specific embodiments there is no intent to limit the scope of the invention except as described in the following claims.

What is claimed is:

1. A staged process for the selective conversion of $C_6$+ naphtha hydrocarbon feedstream containing n-paraffins and naphthenes to $C_6$+ aromatics and light olefins with a reduced production of $C_3$− paraffins, comprising:

contacting said feedstream in an aromatization reaction zone with nonacidic zeolite catalyst particles containing metal from Group VIII of the Periodic Chart of the Elements under aromatization reaction conditions whereby a high selective conversion of said n-paraffins to said aromatics is achieved and said first reaction zone effluent is rich in unconverted naphthenes;

passing said effluent without separation to a naphthenes cracking zone in contact with cracking catalyst comprising acidic zeolite catalyst particles under cracking conditions whereby conversion of said naphthenes to light olefins is achieve while said $C_3$− paraffins production is reduced; and separating effluent from said cracking zone by distillation to recover an overhead stream comprising hydrogen and $C_5$− olefinic hydrocarbons and a bottom stream comprising $C_6$+ hydrocarbons rich in aromatics.

2. The process of claim 1 including the further step of recycling a portion of said bottom stream to said naphtha feedstream and/or said aromatization reaction zone effluent.

3. The process of claim 1 including the further step of separating said aromatization reaction zone effluent by distillation to provide a $C_6$+ hydrocarbon feedstream rich in naphthenes for said second reaction zone.

4. The process claim 1 wherein said aromatization reaction zone catalyst comprises non-acidic medium pore shape selective zeolite catalyst particles containing platinum.

5. The process of claim 4 wherein said catalyst further contains tin.

6. The process of claim 4 wherein said zeolite comprises ZSM-5.

7. The process of claim 4 wherein said zeolite comprises zeolite Beta.

8. The process of claim 1 wherein said aromatization zone catalyst comprises non-acidic ZSM-5 containing platinum and tin.

9. The process of claim 1 wherein said second stage catalyst is ZSM-5, X-zeolite or Y-zeolite.

10. The process of claim 1 wherein at least 80 weight % of said n-paraffins in said feedstream are converted to aromatics in said aromatization reaction zone.

11. The process of claim 1 wherein at least 50 weight % of said naphthenes in said aromatization reaction zone effluent are converted to light olefins in said cracking zone.

12. The process of claim 11 wherein said light olefins comprise $C_2$–$C_5$ olefins.

13. The process of claim 1 wherein the production of said $C_3$− paraffins is less than about 10 weight %.

14. The process of claim 1 wherein said aromatization reaction zone comprises a moving catalyst bed reactor system whereby naphthene conversion is minimized.

15. The process of claim 1 wherein said cracking zone comprises a fixed catalyst bed reactor system with a swing reactor or a fluid catalyst bed reactor system including a riser reactor.

16. The process of claim 1 wherein said non acidic zeolite catalyst further contains metal selected from the group consisting of SN, In and Tl.

17. In the process for naphtha reforming comprising contacting $C_6$+ naphtha feedstream containing n-paraffins and naphthenes with non-acidic medium pore shape selective zeolite catalyst particles containing metal from Group VIII of the Periodic Chart of the Elements under aromatization or dehydrocyclization reaction conditions in an aromatization reaction zone, the improvement comprising:

passing substantially the entire effluent from said aromatization reaction zone to a cracking reaction zone in contact with cracking catalyst comprising medium pore shape selective zeolite catalyst particles under cracking conditions whereby said cracking reaction zone effluent is produced comprising at least an 80 weight % conversion of said n-paraffins to $C_6$+ aromatics and at least 50 weight % conversion of said naphthenes to light olefins;

separating effluent from said second zone by distillation to recover an overhead stream comprising hydrogen and $C_5$− olefinic hydrocarbons and a bottom stream comprising $C_6$+ hydrocarbons rich in aromatics.

18. The process of claim 17 wherein said aromatization reaction zone catalyst comprises non-acidic ZSM-5 containing platinum and tin, Indium or Thallium.

19. The process of claim 17 wherein said cracking zone catalyst is ZSM-5, X-zeolite or Y-zeolite.

20. The process of claim 17 wherein said light olefins comprise $C_2$–$C_5$ olefins.

21. The process of claim 17 wherein the production of $C_3$− paraffins is less than about 10 weight %.

* * * * *